US005253551A

United States Patent [19]

DeVaughn

[11] Patent Number: 5,253,551

[45] Date of Patent: Oct. 19, 1993

[54] CENTRIFUGE TUBE AND CENTRIFUGE TUBE CAP REMOVING AND INSTALLING TOOL AND METHOD

[75] Inventor: Donald H. DeVaughn, San Francisco, Calif.

[73] Assignee: Bio-Pias, Inc., San Francisco, Calif.

[21] Appl. No.: 551,874

[22] Filed: Jul. 12, 1990

[51] Int. Cl.[5] ..... B67B 7/44

[52] U.S. Cl. ..... 81/3.09; 81/3.4; 81/3.55

[58] Field of Search ..... 81/3.09, 3.4, 3.55, 81/3.57

[56] References Cited

U.S. PATENT DOCUMENTS

| | | | |
|---|---|---|---|
| 807,380 | 12/1905 | Hicks | 81/3.57 |
| 1,954,422 | 4/1934 | McIntyre | 81/3.4 |
| 1,960,531 | 5/1934 | Driscoll | 81/3.4 |
| 3,604,290 | 9/1971 | Waite | 81/3.4 |
| 4,542,833 | 9/1985 | DeVaughn . | |
| 4,683,782 | 8/1987 | Warburg | 81/3.57 |
| 4,704,924 | 11/1987 | Echols | 81/3.4 |
| 4,713,219 | 12/1987 | Gerken et al. . | |
| 4,723,465 | 2/1988 | Hughes | 81/3.09 |

FOREIGN PATENT DOCUMENTS

| | | | |
|---|---|---|---|
| 573357 | 3/1976 | Switzerland | 81/3.4 |

*Primary Examiner*—Roscoe V. Parker

*Attorney, Agent, or Firm*—Flehr, Hohbach, Test, Albritton & Herbert

[57] ABSTRACT

An ultracentrifuge with a snap can and a tool for removing or installing the snap cap. The tool also is formed for installing and removing screw caps from centrifuge tubes, test tubes or the like. The ultracentrifuge tube has a balanced positive securement structure with a support collar that supports the tube independently of the cap securement structure. The tool has manually grippable, elongated body constructed of a semi-rigid material, and one end of the tool body includes a slot and a tab protruding from the tool end directly above the slot. The tool tab is formed to engage the top of the snap cap when a pry lip of the snap cap is inserted into the slot. The user can swing the tool up to unsnap the cap from the tube. The opposite end of the tool includes an open ended socket dimensioned and tapered to grippably receive the outer circumferential perimeter of a screw cap for a centrifuge tube thereby facilitating easy removal or installation. The socket is placed over the cap and the tool rotated to remove the cap. Once removed the cap is frictionally retained in the socket. A method of removing and remounting centrifuge caps also is described.

3 Claims, 5 Drawing Sheets

CENTRIFUGE TUBE AND CENTRIFUGE TUBE CAP REMOVING AND INSTALLING TOOL AND METHOD

TECHNICAL FIELD

The present invention relates, in general, to centrifuge tubes and the handling or manipulation of end closures therefor, and more particularly, the invention relates to an ultracentrifuge tube and a tool and method for removing and/or installing screw caps and snap caps on microcentrifuge and ultracentrifuge tubes.

BACKGROUND OF THE INVENTION

In the field of medical science and research, it is often necessary to seal and unseal the open ends of centrifuge tubes, test tubes, culture tubes and the like. Medical and research technicians use centrifuges for various purposes, but mainly for separating the compounds of a multi-component fluid. The tubes used for such centrifugal separation generally include conventional glass or plastic lab tubes, or plastic tubes specifically designed to be used in centrifuge machines.

The high speed of the centrifuge process, coupled with the need to retain and control specimens in the tubes, make sealing of the open ends of the tubes with sealing caps necessary to prevent spillage or leakage. Typical closures for sealing the open end of centrifuge tubes include snap caps, such as is shown in Gerken et al. U.S. Pat. No. 4,713,219, screw caps, such as are employed for many containers; and stretchable caps, such as the stretchable cap disclosed in De Vaughn, U.S. Pat. No. 4,542,833.

When only small amounts of fluid are necessary to be centrifuged, microcentrifuge or ultracentrifuge tubes may replace normal test tubes thereby saving space and costs. Perhaps the most common microcentrifuge tubes are of the type manufactured by Bio Plas, Inc., which utilize either snap caps or screw-on caps. These snap cap tubes are available in a variety of sizes, depending on their purpose. They employ a snap cap structure including a transversely extending end wall with a cap skirt which extends into the open end of the tube. An annular protruding bead on the skirt engages and seals against the inside of the microcentrifuge tube. Screw cap tubes employ a tube body having a threaded exterior end which mates with interior threads on the cap.

Microcentrifuge tubes are used in centrifuges which operate at speeds of up to about 20,000 RPM. For some separation applications, however, even greater speeds are required. In recent years, therefore, ultracentrifuges have been developed in which angular velocities as high as 45,000 RPM are possible. Such ultracentrifuges require a tube which is closed more positively than the conventional snap caps used on microcentrifuge tubes. Moreover, as the centrifugal forces build in the ultracentrifuge range, the weight of the tube and its contents must be supported in a manner which will not force open the tube cap.

The small size and large quantity of microcentrifuge and ultracentrifuge tubes handled by lab technicians, makes snapping and unsnapping, or screwing and unscrewing the caps from the tubes quite tedious and monotonous. As the snap cap closure structure becomes more positive in its securement of the cap on the tube, the removal of the snap cap becomes quite difficult and possibly painful or injurious. The technician must grab a small protruding lip of the snap cap and pry off the cap by inserting fingertips or a prying tool between the tube and the cap. This repetitious prying technique becomes very cumbersome, and can be complicated by the need for the lab technician to wear gloves. Moreover, the process of prying snap caps off centrifuge tubes can cause contamination of the specimen in the tube.

Similarly, the screw-on cap microcentrifuge tubes require the user to properly align the screw-on caps to the tubes in order to engage the thread structure. This seemingly common task appears very simple; however, because of the small size of the objects and the shear volume in usage, the task, again, becomes quite tedious. Moreover, the screw-on caps are often misplaced between removal and remounting, rendering the tube unusable if the original cap or another cap cannot be located.

Accordingly, it is an object of the present invention to provide a centrifuge tube which is particularly suited for use in ultracentrifuges and to provide centrifuge tube and cap assembly in which the cap is more positively secured to the tube and the centrifugal forces are supported independently of the cap securement structure.

It is another object of the present invention to provide a cap manipulating tool which can be used to remove the remount snap caps and screw caps from centrifuge tubes.

It is a further object of the present invention to provide a cap manipulating tool which is suitable for use in removing and remounting of positively secured snap caps from ultracentrifuge tubes.

Another object of the present invention is to provide an apparatus and method for removing screw caps from microcentrifuge tubes and for retaining control of the caps for subsequent remounting on the tubes.

It is still another object of the present invention to provide a cap manipulating tool which reduces the risks of injury and contamination and also reduces the tedium of removing and installing caps from centrifuge tubes.

A further object of the present invention is to provide a method and device which will reduce the time required for a technician to remove and install snap caps and screw caps on microcentrifuge tubes.

Another object of the present invention is to provide a centrifuge tube and a centrifuge tube cap manipulating tool which are durable, compact, easy to maintain, are disposable, have a minimum number of components and are economical to manufacture.

Still a further object of the present invention is to provide a centrifuge tube having a snap cap with an improved sealing structure suitable for use in an ultracentrifuge.

The device of the present invention has other objects and features of advantage which will become apparent from, and are set forth in more detail in, the description of the Best Mode of Carrying Out the Invention and the accompanying drawing.

SUMMARY OF THE INVENTION

The centrifuge tube of the present invention has an elongated hollow body with an open upper end, and a snap cap removably mounted in the open by interengaged cap securement shoulders. In one aspect, the improved centrifuge tube has a support collar is provided for supporting the weight of the tube and its contents independently of the cap securement shoulders. In another aspect the improved centrifuge tube has a circumferentially balanced snap cap securement structure.

The cap manipulating tool of the present invention is particularly suitable for use with microcentrifuge and ultracentrifuge tubes utilizing a snap cap or a screw cap. The tool of the present invention is comprised, briefly, of a manually grippable elongated body with a snap cap engaging structure formed for removing or installing snap-type caps as employed, for example, on microcentrifuge and ultracentrifuge tubes. This snap cap engaging structure preferably includes a slot dimensioned to slidably receive a protruding lip portion common to snap caps. The slot is defined in part by an upwardly facing tool surface which engages a downwardly facing surface on the lip, and the snap cap engaging structure further includes a tab located directly above and adjacent to the slot. The tab extends outwardly from the slot and includes a downwardly facing tool surface which engages the top end surface of the snap cap radially inwardly of the lip. The body of the tool extends in a direction opposite to that of the tab to provide a lever which can be used to pry the snap cap off the tube by employing an arcuate lifting motion.

Furthermore, in the present tool's preferable form, the end opposite the snap cap engaging structure is formed with a screw cap engaging structure for removing or installing a screw cap of the type commonly utilized on screw cap centrifuge tubes. This screw cap engaging structure includes a socket provided with a friction structure, such as ribs, which grippingly receives the perimeter of the screw cap. Placing the socket, which preferably is tapered, over the screw cap, while manually turning the tool applies a torsion force, in either a clockwise or counterclockwise direction, to thereby facilitate removal or installation of the cap. The socket has sufficient interference fit with the screw cap to frictionally retain the screw cap in the socket once the cap is removed from the tube. When remounting the cap on the tube, the socket can be released from the cap by continuing to turn the tool after the cap has been screwed tightly onto the tube.

The cap removal or installing device of the present invention and the method in which it is used will be described in more detail below in conjunction with the drawings.

BEST MODE FOR CARRYING OUT THE INVENTION

Reference will now be made in detail to the preferred embodiments of the invention, examples of which are illustrated in the accompanying drawings. While the present invention has been described with reference to a few specific embodiments, the description is illustrative of the invention and is not to be construed as limiting the invention. Various modifications may occur to those skilled in the art without departing from the true spirit and scope of the invention as defined by the appended claims.

Figure 1:
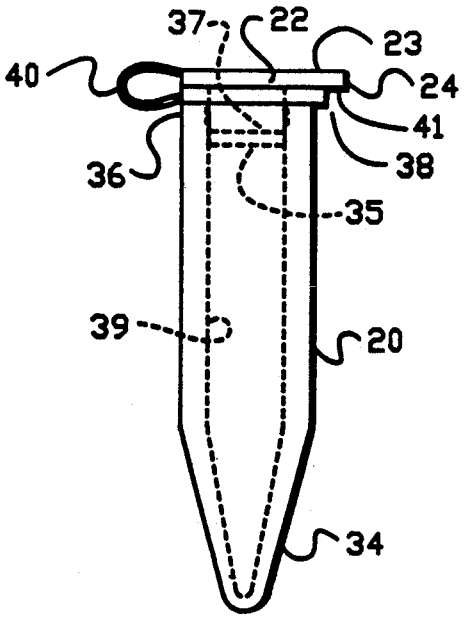
FIG. 1 is a side elevation view showing a conventional microcentrifuge tube having a snap cap.
Figure 2:
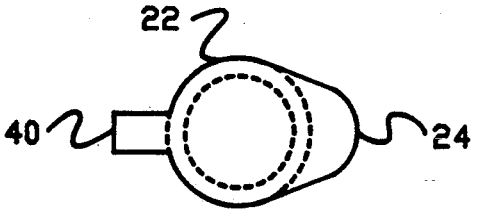
FIG. 2 is a top plan view of the microcentrifuge tube illustrated in FIG. 1.

Turning now to the drawings, wherein like components are designated by like reference numerals throughout the various figures, attention is directed to FIG. 1 which illustrates a conventional microcentrifuge tube 20 employing snap cap 22 for sealing purposes. The particular tube illustrated is a plastic or polypropylene material having closed end 34 and an open upper end 36 in which cap 22 is removably mounted. Snap cap 22 often is formed as a single integral unit with tube 20 and is attached to microcentrifuge tube 20 via a flexible strap-like connection hinge 40. Depending downwardly from cap 22 is a cap skirt portion 35 having a circumferentially extending sealing bead 37 which engages and seals against the inner surface 39 of tube 20.

In order to permit removal of snap cap 22 from tube 20, cap 22 preferably includes protruding lip portion 24. Lip 24, however, is very hard to grip, particularly for microcentrifuge tubes which are relatively small (e.g., 1.25 to 1.75 inches high). The user must attempt to engage downwardly facing lip surface 41 with a finger tip or finger nail and pry the snap cap out of open end 36 of the tube. In small (1.25 inch high) microcentrifuge tubes lip surface 4 extends only about 0.045 inches beyond tube collar 38. In 1.75 inch long tubes lip surface 41 extends by only about 0.090 inches.

Thus, the lab technician must grip the very small tube in one hand and use the other to pry cap 22 off the tube, which is resisted by the frictional engagement of skirt 35 and sealing bead 37. When hundreds, or even thousands, of tubes must be opened and closed, the task of manipulating such snap caps becomes very tedious, time consuming and sometimes can result in injury to the technician and even contamination of the specimen in the tube or dropping of the tube and loss of the specimen.

Figure 4:
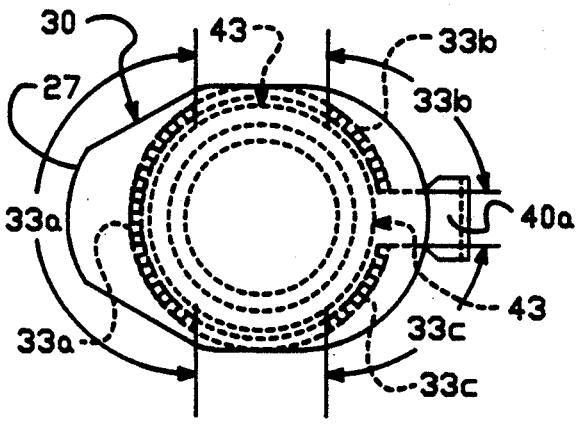
FIG. 4 is a top plan view of the ultracentrifuge tube illustrated in FIG. 3 with the cap in a closed position.
Figure 3:
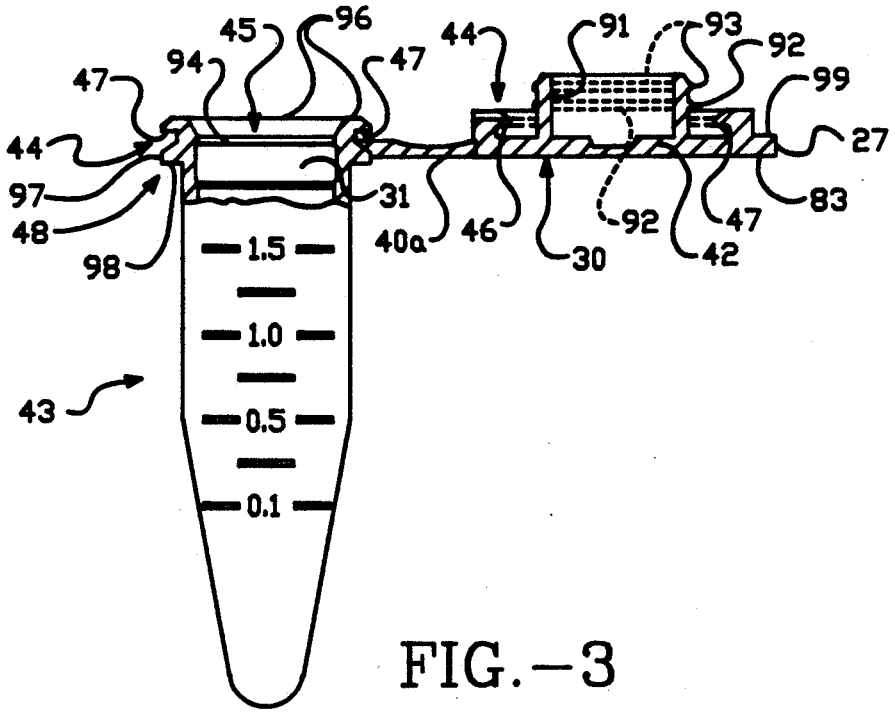
FIG. 3 is a side elevation view, partially in cross section, of a ultracentrifuge tube constructed in accordance with the present invention and having a snap cap in an open position.

FIGS. 3 and 4 illustrate a snap cap centrifuge tube 43 which is particularly well suited for use in an ultracentrifuge as a result of its very positive snap cap securement structure, generally designed 44. As will be understood, however, centrifuge tube 43 also can be used in microcentrifuges and for other general purpose laboratory applications.

Figure 3A:
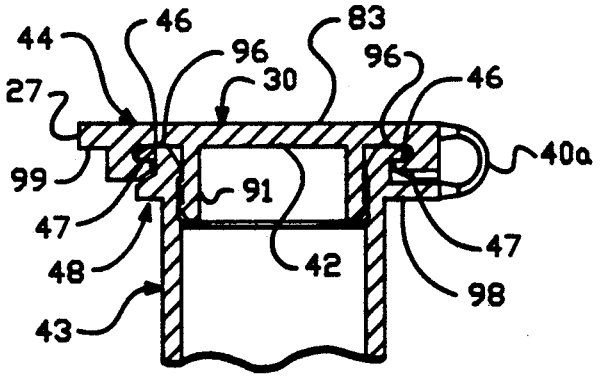
FIG. 3A is a fragmentary, side elevation view, in cross section corresponding to FIG. 3 with the snap cap in a closed position.

Tube 43 has an elongated hollow tube body with an open upper end 45. As used herein, expressions such as "upper," "upwardly facing" and "downwardly facing" shall refer to tube 43 in a vertical orientation as shown in FIG. 3A, with the snap cap 30 in a closed position or mounted in open end 45. It will be understood that both tube 43 and cap 30 can be oriented in other directions during normal use. Cap 30, for example is normally inverted when it is opened as shown in FIG. 3.

Cap securement means 44 includes a downwardly facing shoulder means 47 on an exterior surface of the tube body proximate end 45 and an upwardly facing shoulder means or catch, generally designated 46, on snap cap 30. Cap 30 also includes transverse cap wall 42 which extends across open end 45 when the cap is closed (FIG. 3A). Depending downwardly from wall 42 is an annular skirt 91 which engages interior surface 31 of the tube body proximate open end 46.

As thus far described ultracentrifuge tube 44 is formed in a manner known in prior centrifuge tubes, for example, the centrifuge tube of U.S. Pat. No. 4,713,219 to Gerken et al. The ultracentrifuge tube of the present invention, however, is formed with an improved snap cap securement and sealing configuration and an improved tube support structure.

In order to ensure that ultracentrifuge tube snap cap 30 is positively secured and sealed in open end 45, downwardly facing shoulder 47 on tube 43 and upwardly facing shoulder 46 on cap 30 include three interengaged shoulder portions 33*a*, 33*b* and 33*c* positioned about the periphery of the tube body at locations which provide circumferentially balanced, positive securement of the snap cap to the tube. As best may be seen in FIG. 4, cross-hatched area 33*a*, representing interengaged portions of shoulders 46 and 47, is opposite flexible hinge 40*a* coupling the cap to the tube body. That general approach, using a catch on the side of the tube opposite the hinge also is shown in the Gerken et al. patent. It has been found, however, that for ultracentrifuge applications a single catch or set of interengaged shoulder portions 33*a* opposite hinge 40*a* is not sufficient.

Thus, in the present invention downwardly facing shoulder 47 on the tube body is provided by an annular flange which extends circumferentially substantially entirely around the tube body, and cap 30 includes upwardly facing shoulder 46 on a circumferentially and radially inwardly extending lip on the cap at areas 33*b* and 33*c* on either side of hinge 40*a*. As will be seen from FIG. 4, therefore, interengaged shoulder portion 33*b* and 33*c* balance or oppose interengaged shoulder portions 33*a* to provide a very positive locking of the snap cap on the centrifuge tube.

Figure 3B:
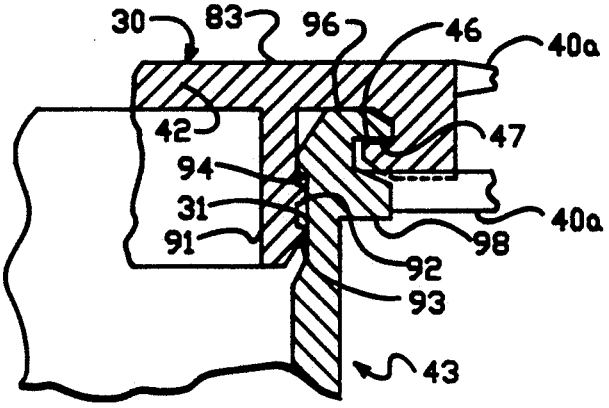
FIG. 3B is an enlarged, fragmentary, side elevation view of the sealing structure of the ultracentrifuge tube of FIG. 3A.

Additionally, in the centrifuge tube of the present invention, improved sealing means are provided. Instead of having a single annular sealing bead, such as bead 37 on the skirt 35 of microcentrifuge tube 20, or two beads, as shown in the Gerken et al. patent, ultracentrifuge tube skirt 91 is provided with two annular radially outwardly protruding beads 92 and 93 and tube surface 31 is provided with a radially inwardly protruding annular sealing ridge 94 (FIG. 3B) which engages skirt 91.

Thus, in tube 43 two sealing beads 92 and 93, sealing ridge 94, and an upper end surface 96 all are held in tight sealed relation to their opposing surfaces by the circumferentially balanced positive securement shoulder 46 and 47. Even at high ultracentrifuge velocities and after exposure to cryogenic to autoclave temperatures, tube 43 will reliably retain its contents.

A problem which also has been encountered with centrifuge tube constructed as shown in Gerken et al. U.S. Pat. No. 4,713,219 is that the weight of the centrifuge tube and its contents will bear upon the securement latch structure during centrifuging. Centrifuge tubes are typically placed in cylindrical pockets or sleeves which slidably receive the tubes. The hinge area and latch area in the Gerken et al. patent rest and are supported on the centrifuge pockets or sleeves. As forces build during centrifuging, there is some tendency to force the latch assembly open.

In order to support centrifuge tube 43 during centrifuging independently of securement structure 44, support collar means 48 is provided in the exterior surface of the tube body. Collar means 48 preferably is provided by a circumferentially extending lip 97 having a downwardly facing support surface 98 that engages the centrifuge pocket or sleeve. Lip 97 is proximate and axially below securement means 44 so as to support the tube substantially independently of the securement shoulders.

Since tube 43 includes a very positive and balanced cap securement structure, removal of the snap cap is difficult and snap cap 30 further preferably includes a cap prying lip 27 having a pry surface 99 which can be engaged by the snap cap removal tool of the present invention. Surface 99 preferably is generally parallel to the end surface of cap wall 42 to provide a good prying surface for prying open the snap cap using the cap removal tool of the present invention.

As will be apparent, the problems associated with prying the very securely mounted snap cap 30 off tube 43 by engaging downwardly facing lip surface 99 and prying lip 27 up off tube end 45 are substantial. The interengaged shoulders, which are required to maintain a seal at the extremely high ultracentrifuge velocities, resist opening of the tube and make tube handling even more difficult than microcentrifuge tubes.

Figure 5:
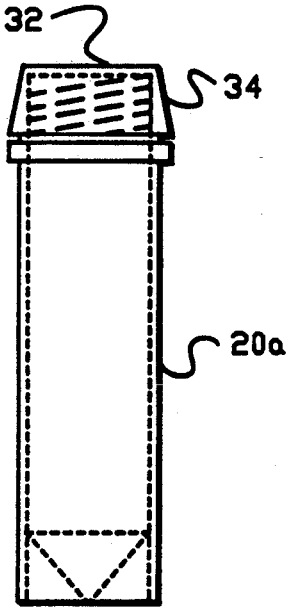
FIG. 5 is a side elevation view showing a conventional microcentrifuge tube having a screw cap.
Figure 5A:
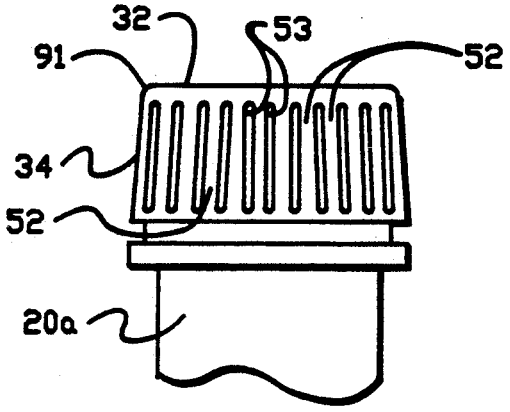
FIG. 5A is an enlarged, fragmentary side elevation view of the cap of FIG. 5.

FIG. 5 shows a side elevational view of microcentrifuge tube 20*a* employing threaded screw cap 32. As illustrated, side circumferential periphery 34 of screw-on cap 32 is tapered and typically includes circumferentially spaced, longitudinal, friction-enhancing ribs 52 (as defined by grooves or recesses 53 in FIG. 5A). Cap 32 includes an 0-ring (not shown) against which the end of tube 20*a* seals.

The manipulation or handling problem posed by a screw cap type, microcentrifuge tube 20*a* is that the small size of the tubes, for example cap 32 is only ½ inch in diameter, makes repetitive unscrewing and screwing of the caps very tedious. Additionally, once caps 32 are removed from tubes 20*a*, there is considerable opportunity to misplace or lose the caps, since they are not connected by a strap or hinge to the tubes. If caps 32 are set down on their sides, there also is a tendency for them to roll.

The centrifuge cap manipulating tool of the present invention can be seen in FIGS. 6–10, and in its most preferred form it is suitable for use in removing and remounting snap caps for microcentrifuge tubes ultracentrifuge tubes and centrifuge tubes with screw caps.

Cap manipulating tool, generally designated 50, includes manually-grippable, elongated body 52 with snap cap engaging means, generally indicated by reference numeral 54, and screw cap engaging means, generally indicated by reference numeral 56. This, of course, does not exclude the possibility that tool 50 may only include one or the other of snap cap engaging means 54 or a screw cap engaging means 56.

Tool 50 preferably is integrally formed with both structures as a single unit from a semi-rigid material, preferably polypropylene. It will be understood that other suitable materials may be used. For cost saving purposes, as well as processing purposes, elongated body 52 is hollow and frusto-conical in shape. Other geometrically dimensioned bodies may, however, be practical.

Figure 6:
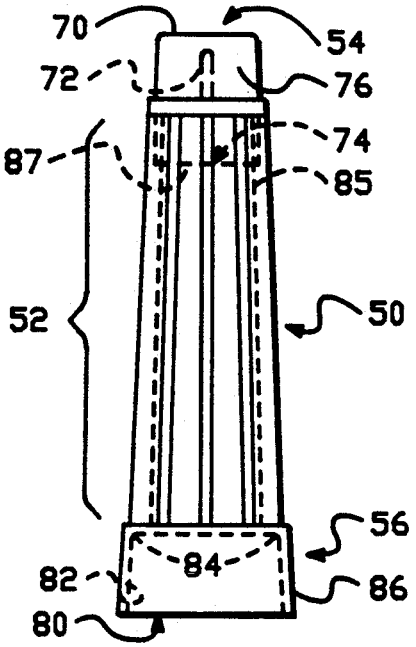
FIG. 6 is a front elevation view showing a cap manipulating tool constructed in accordance with the present invention.
Figure 7:
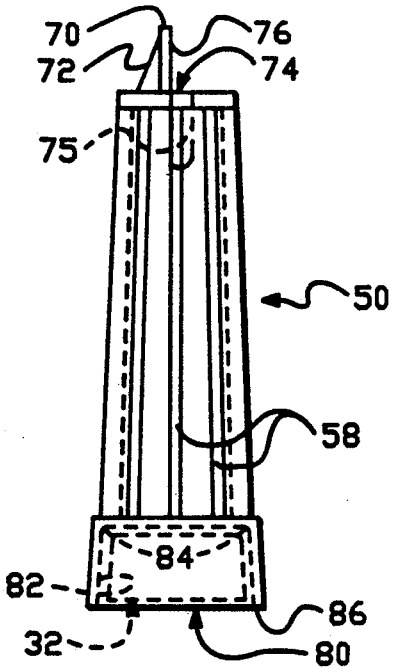
FIG. 7 is a side elevation view of the cap manipulating tool of FIG. 6.
Figure 10:
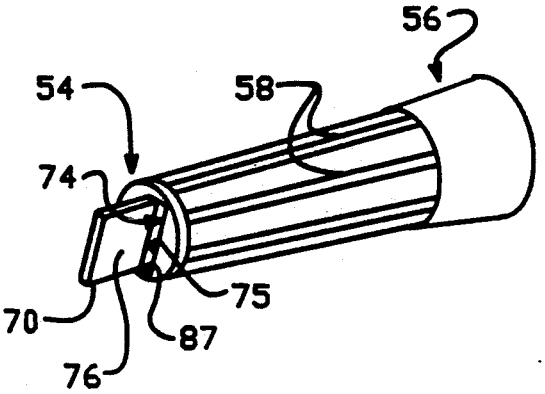
FIG. 10 is a top perspective view of the cap manipulating tool of FIG. 6.

As shown in FIGS. 6, 7 and 10, elongated body 52 contains circumferentially spaced, longitudinally extending gripping ribs 58. These ribs facilitate gripping by the user but are not necessary in many instances.

In order to provide a structure which is capable of applying a substantial prying force or moment to snap caps of the type found on centrifuge tubes, snap cap engaging means 54 preferably includes an upwardly facing first tool surface 75 formed and positioned to engage downwardly facing lip surfaces 41 and 99. Additionally, snap cap engaging means or structure 54 includes a downwardly facing second tool surface 76, which extends outwardly of surface 75, to engage an upwardly facing end surface of caps 22 and 30. As used herein in connection with tool 50, the expressions "upwardly facing" and "downwardly facing" also shall be understood to be relative expressions, relating to the tool when used to remove a cap from tubes oriented in a substantially vertical orientation, as shown in FIGS. 1, 3A and 5 of the drawing.

Figure 11:
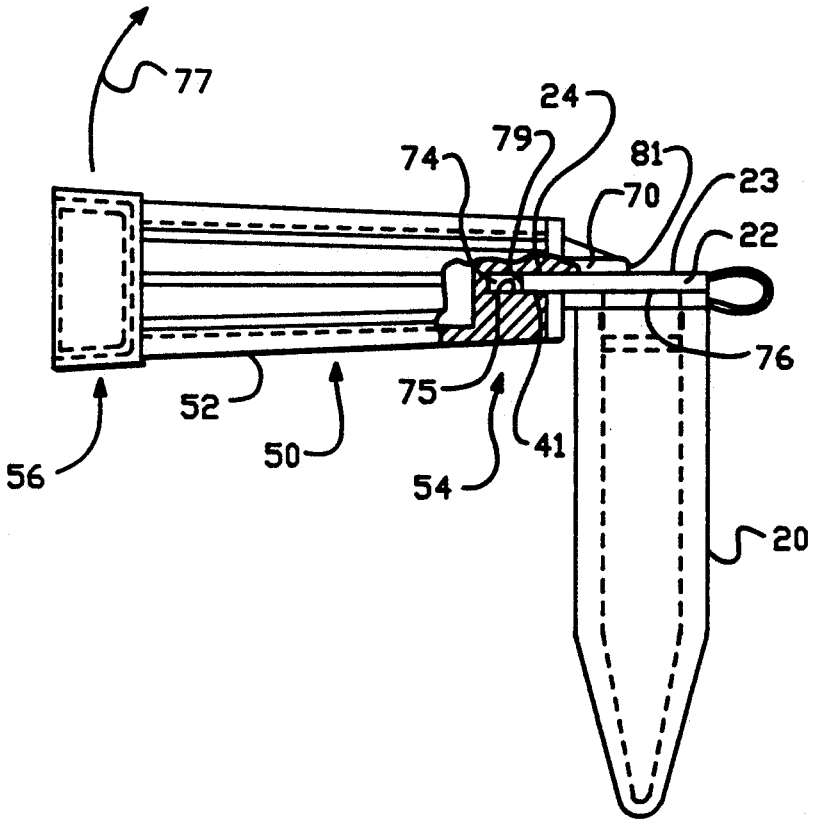
FIG. 11 is a side elevation view, partially broken away, of the cap manipulating tool of FIG. 6 engaged with the microcentrifuge tube of FIG. 1 for removal of the snap cap.

As best may be seen in FIGS. 7 and 11, the upwardly facing surface is provided by a bottom surface 75 defining slot 74 in the body of the tool. Slot 74 slidably receives lip 24 so that lip surface 41 is engaged by first tool surface 75. Tab 70 extends radially inwardly over cap 22 so that downwardly facing second tool surface 76 on tab 70 engages end surface 23 on cap 22 at a position inwardly of lip 24.

In order to provide a lever arm for the application of prying forces to cap 22, body 52 of the tool extends away from the slot and tab structure in a direction opposed to tab 70. A user can hold tube 20 in one hand and tool 50 in the other. The user then applies a lifting force in the direction of arrow 77. The cap manipulating tool will tilt upwardly, with tool surface 75 engaging surface 41 of the lip proximate lip end 79 and tool surface 76 engaging cap end surface 23 proximate end 81 of the tab. Tool body 52 affords the user a lever with a mechanical advantage many times greater than the mechanical advantage provided by lip 24 for the application of a prying moment to cap 22 between lip end 79 and tab ends 81.

The result is that tool 50 can be used not only to rapidly, and almost effortlessly, pry open snap caps on microcentrifuge tubes, but it also can be used to pry open the much more difficult to open ultracentrifuge tubes. Thus, slot 74 is dimensioned to receive lip 27 with surface 75 engaging lip surface 99 and tab surface 76 engaging top surface 83 on the cap end. The prying action between the slot and tab of the tool will bend the flexible polypropylene cap to aid in disengagement of interengaged cap shoulder portions 33*a*, and thereafter the disengagement of shoulder portions 33*b* and 33*c*.

Figure 12:
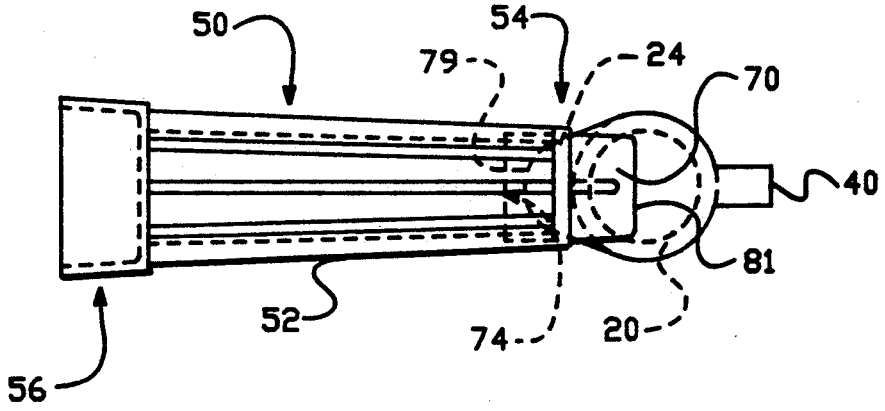
FIG. 12 is a top plan view of the cap manipulating tool and microcentrifuge tube illustrated in FIG. 11.

Tool 50 also can be used advantageously to remount snap cops to centrifuge tubes. Slot 74 can be placed over lip 24 or lip 27, and tab 70 used to press cap 22 or cap 30 down onto the tube. The cap pivots about hinge strap 40 or 40*a* during the remounting process. It should be noted that it is preferable to form slot 74 in body 52 with side walls 85 and 87 (FIG. 9) which limit lateral shifting of lip 24 in slot 74. Slot 74 could, however be formed with open sides and still provide an effective prying surface. Similarly, tab 70 could be replaced by an outwardly extending narrow arm, such as central reinforcing rib 72. Tab or planar extension 70 has the advantage of line contact (see FIG. 12 at 81) which is effective in bending cap 22 to assist in prying. It is preferable that tab 70 extend out to about the middle of the snap cap, but even tabs which extend out only 20% of the radius of the tube can be effective, particularly with microcentrifuge tubes.

Figure 8:
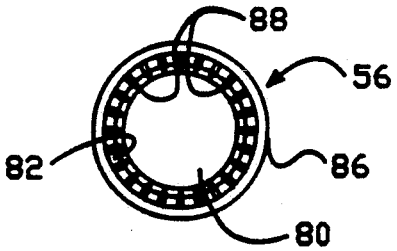
FIG. 8 is a bottom plan view of the cap manipulating tool illustrated in FIG. 6.

Turning now to FIGS. 6–8, the details of construction of the screw cap engaging means 56 can be described. The screw cap engaging structure preferably is provided by a socket 80, as defined by circumferential wall 86. Since screw caps 34 of the type used on microcentrifuge tubes usually have an outwardly tapering surface, wall 86 defining socket 80 preferably has an inner surface 82 which is tapered to substantially mate with or match the taper on caps 32. The circumferential juncture between elongated body 52 and the upper circumferential edge of frustum shaped socket 80 defines a fillet, generally designated 84, that receives the rounded edge 91 of cap 32 and limits the depth to which the cap can be urged into tapering socket 80. As will be described hereinbelow, screw cap 32 will abut fillet 84 when cap removal or replacement is undertaken. Additionally, inner surface 82 the socket preferably is formed with circumferentially spaced longitudinal ribbing 88 (see FIG. 8) to enhance friction with screw cap 32.

Figure 8A:
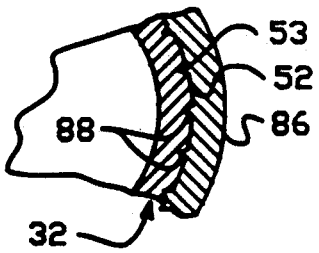
FIG. 8A is an enlarged, fragmentary, bottom plan view in cross section, taken substantially along the plane of line 8A—8A in FIG. 13.
Figure 9:
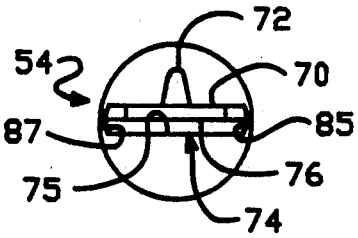
FIG. 9 is an end elevation view of the cap manipulating tool illustrated in FIG. 6.

As best may be seen in FIG. 8A, cap 32 has a plurality of circumferentially spaced, longitudinally extending grooves 53 which define arcuate lands 52, between the grooves. Socket 80, therefore, preferably is formed with ribs 88, which substantially mate with grooves 53, and yet are capable of being urged circumferentially until they are displaced out of grooves 53 and slide along cap lands 52. In the preferred form ribs 88 are protrude inwardly of the socket surface by only a few thousands of an inch. The tapering socket surface 82, for example, by about 0.010 to about 0.020 inches on the diameter from fillet 84 to the open end, insures mating of the tool socket with caps of somewhat different dimensions. The socket depth, limited for example by fillets 84, limits the ability to jam the socket too tightly onto the cap.

It is an important feature of the present invention that frusto-conical socket 80 be formed and dimensioned so that it will frictionally retain cap 32 in socket 80 when the cap is removed from the microcentrifuge tube. As will be seen from FIG. 7, therefore, socket 80 frictionally retains cap 32 in tool 50 when the cap is removed from body 20*a* of the microcentrifuge tube of FIGS. 5 and 5A. This is important because the round screw caps are small and round and tend to be easily misplaced or roll away when placed on a sloping surface. Tool 50, however, is much less likely to be misplaced and ribs 58 tend to limit rolling. Since the technician usually opens one centrifuge tue at a time, retention of cap 32 in socket 80 does not pose a problem, and obviously multiple tools can be used if more than one tube must be opened at a given time.

A further important feature of screw cap socket 80 is that it may be easily removed from the cap when the cap is tightened down on tube body 20*a*. The use of the tool merely has to overturn or continue to rotate the tool until ribs 88 are urged out of grooves 53, at which point the socket rotates relatively freely with respect to the cap. The continued rotation and the tapered socket tend to cause the tool to automatically be axially displaced away from cap 32 so that the tool releases easily from the cap. Additionally, this automatic release feature of socket 80 causes the socket to act in a manner similar to a torque wrench. Thus, the ribs 88 will not escape grooves 53 until about the same tightening torque has been applied to cap 32.

Figure 13:
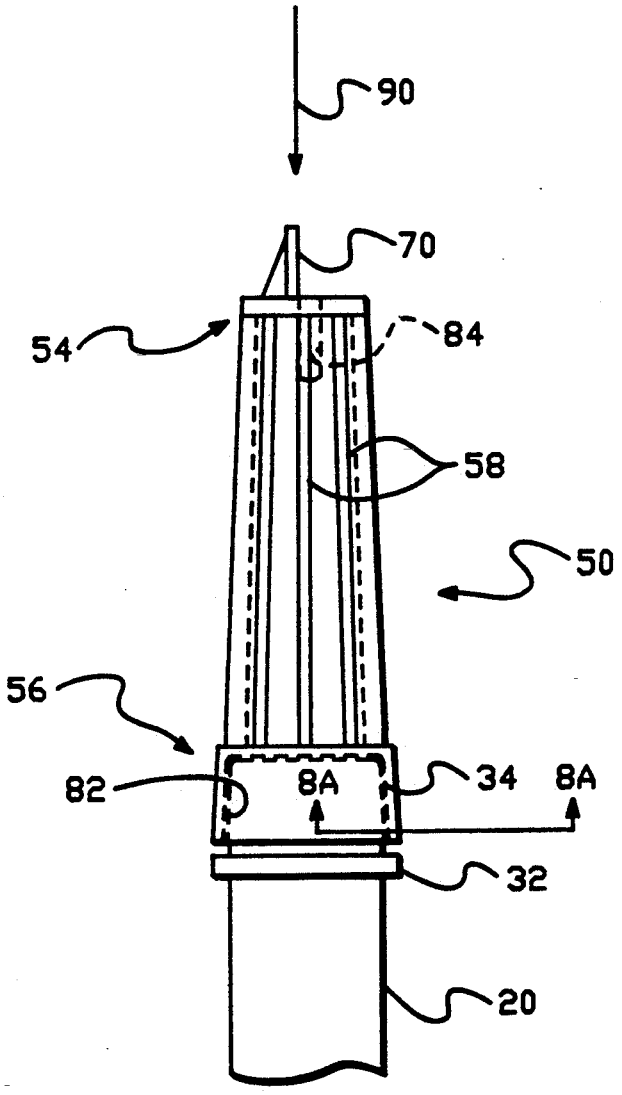
FIG. 13 is a side elevation view of the cap manipulating tool of FIG. 6 engaged with the microcentrifuge tube of FIG. 5 for removal of the screw cap.

Using tool 50, therefore, an improved method of removing and remounting screw caps on centrifuge tube can be performed. The first step of the method is the step of sliding socket 80 down over screw cap 32, as shown by arrow 90 in FIG. 13, until the socket is in sufficient frictional engagement with the cap to enable cap rotation and to retain the cap in the socket. Next the tool is rotated in a direction unscrewing the cap until the cap can be removed from the tube. The cap is retained by the socket in the tool until it is to be remounted. Remounting is accomplished by rotating the tool in an opposite direction until the cap is tightly screwed down on the tube, and thereafter overturning, or rotating the tool further, until ribs 88 release from grooves 53.

While in the foregoing specification this invention has been described in relation to certain preferred embodiments thereof, and many details have been set forth for purposes of illustration, it will be apparent to those skilled in the art that the invention is susceptible to additional embodiments and that certain of the details described herein can be varied considerably without department from the basic principles of the invention.

What is claimed is:

1. A cap manipulating tool for opening and closing any one of a snap cap, removably mounted in, and a screw cap, threadably mounted on, an open end of a centrifuge tube, said snap cap having an upwardly facing end surface and a circumferentially protruding lip portion with a downwardly facing lip surface, said tool comprising:

an elongated body having a longitudinally extending body axis;

snap cap engaging means coupled to one end of said body and including a substantially planar surface on said body defining an opening of a slot dimensioned to receive said lip portion, said opening being flush with said planar surface and said slot having an upwardly facing slot surface formed and positioned for engagement with said lip surface, and a tab portion proximate and extending outwardly of said slot, said tab portion having a downwardly facing tab surface extending outwardly of said slot surface to engage said end surface at a position radially inward of said lip portion, and said body extending away from said snap cap engaging means to provide a manually grippable lever for application of opening and closing forces to said snap cap; and screw cap engaging means coupled to an opposing end of said body and defining socket means having a socket axis axially aligned substantially with said body axis, said socket means being formed and dimensioned to receive said screw cap, said screw cap engaging means including substantially rigid friction means for applying a torsional force to said screw cap to screw said screw cap on and off said tube, and for retaining said screw cap in said tool when said screw cap is unscrewed from said tube.

2. The cap manipulating tool as defined in claim 1 wherein, said slot and tab are both oriented to extend in directions substantially parallel to a longitudinal axis of said body.

3. The cap manipulating tool as defined in claim 1 wherein, said socket means is formed and dimensioned for release and removal from said screw cap by overturning said tool when said screw cap is tightly screwed onto said tube.

* * * * *